US005769616A

United States Patent [19]

Mencarelli et al.

[11] Patent Number: 5,769,616

[45] Date of Patent: Jun. 23, 1998

[54] SUBMERGED PUMP WITH COAXIAL OPPOSING PISTONS, DRIVEN BY DOUBLE LOBED CAMSHAFT

[76] Inventors: Enzo Mencarelli, via Imbriani, 15-20100 Milano; Giovanni Cefis, via Alighieri, 1-06012 Città di Castello, both of Italy

[21] Appl. No.: 553,258

[22] PCT Filed: Apr. 11, 1994

[86] PCT No.: PCT/IT94/00042

§ 371 Date: Nov. 13, 1995

§ 102(e) Date: Nov. 13, 1995

[87] PCT Pub. No.: WO95/27853

PCT Pub. Date: Oct. 19, 1995

[51] Int. Cl.[6] ..... F04B 19/00

[52] U.S. Cl. ..... 417/486; 417/487; 92/138

[58] Field of Search ..... 417/415, 448, 417/486, 487; 92/72, 138

[56] References Cited

U.S. PATENT DOCUMENTS

| | | | |
|---|---|---|---|
| 2,784,676 | 3/1957 | Woodward | 92/138 |
| 4,322,201 | 3/1982 | Archibald . | |
| 4,569,643 | 2/1986 | Draper | 92/138 |

FOREIGN PATENT DOCUMENTS

| | | | |
|---|---|---|---|
| 1365708 | 7/1963 | France | 417/486 |
| 2232225 | 12/1974 | France . | |
| 2 310 479 | 1/1977 | France | 417/486 |
| 2667116 | 3/1992 | France . | |
| 637586 | 6/1939 | Germany . | |
| 812620 | 9/1951 | Germany | 417/486 |

*Primary Examiner*—Charles G. Freay

*Attorney, Agent, or Firm*—Beveridge, DeGrandi, Weilacher & Young, L.L.P.

[57] ABSTRACT

The submerged pump according to the present invention comprises one or more modular pumping groups, each consisting of a balanced, coaxial and opposing piston couple 7 on spool wheels 10 and with a spring 12 return.

9 Claims, 2 Drawing Sheets

SUBMERGED PUMP WITH COAXIAL OPPOSING PISTONS, DRIVEN BY DOUBLE LOBED CAMSHAFT

SUMMARY AND BACKGROUND OF THE INVENTION

The present invention relates to a submerged pump with coaxial opposing modular pistons, operated by double eccentric cams or similar, of the kind that may also be applied to wells having small diameters, so as to absorb moderate power but having a high efficiency for high pressures.

At present, submerged pumps of the centrifugal kind are known which have good efficiency, but may not be built, if the requested pressures are high, for powers below a determined practical threshold (500–700 Watt).

For high pressures with smaller powers it has consequently proved necessary to make use of volumetrical pumps; however, these pump are not manufactured at a size that might be submerged in a well, although some have tried without success, due to the excessive complications and the fragility thereof.

It is the aim of the present invention to realize a submerged pump having low power and high efficiency, for high pressures.

The aim set forth is reached by means of the submerged pump according to the present invention, comprising one or more modular pumping groups, each consisting of a couple of balanced, coaxial and opposing pistons on spool wheels with a spring return.

Said pumping groups according to the present invention are operating in a parallel manner onto one and the same working or pumping chamber communicating with non-return valves, one for suction and one for outlet, and they may be piled up, and engaged together with, for instance, tie-rods, in a greater or smaller number, thus obtaining differentiated capacities and powers.

According to the aim of the present invention, the pistons have a large diameter and a small run, and their sealing is determined by elastomeric, flexible membranes resting on bevels that guarantee their functioning also in presence of great pressures.

In a similar manner, the valves of the pump are realized with elastomeric flexible membranes onto small slits that are functional also under great pressures.

The submerged pump according to the present invention has the following considerable and many advantages:

- no practical limit inherent to the pressures;
- a high efficiency that is typical for volumetrical pumps;
- low friction and mechanical losses;
- balanced internal and external forces;
- lack of vibrations;
- simplicity, strength and high efficiency;
- low diametrical encumbrance, possibility of a total cylindrical elongated shape, suited for being submerged also in wells having a small diameter;
- modular capacities and powers, without any lower practical limit;
- possibility of realization in small dimensions, according to the need;
- a particular suitability to applications fed by sun energy, or applications with low power.

BRIEF DESCRIPTION OF THE DRAWINGS

The present invention will be described more in detail hereinbelow relating to the enclosed drawings in which a preferred embodiment is shown.

DETAILED DESCRIPTION OF THE DRAWINGS

Figure 1:
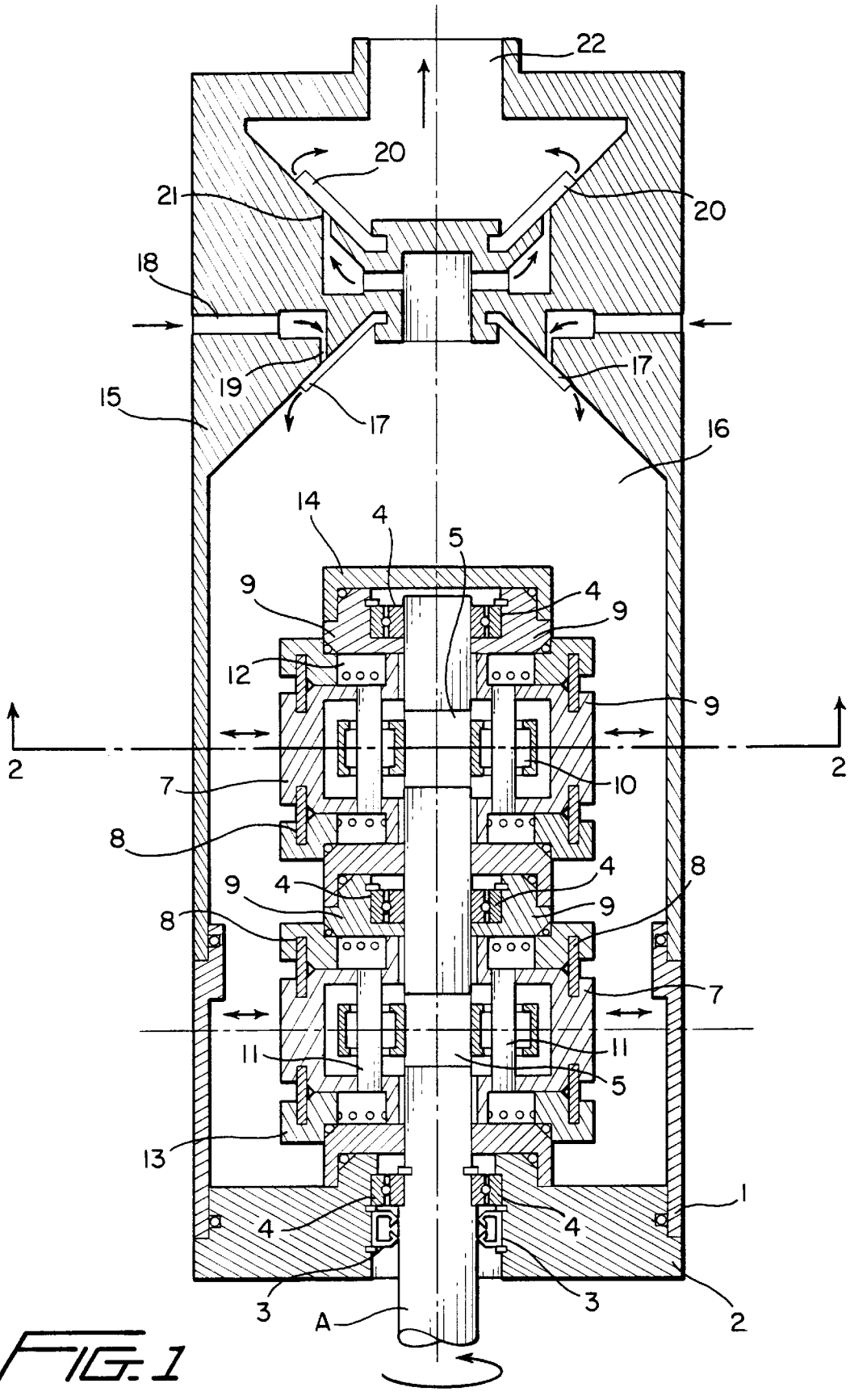
FIG. 1 shows a vertical scheme of a submerged pump with coaxial, opposing and modular pistons operated by double eccentric cams.
Figure 2:
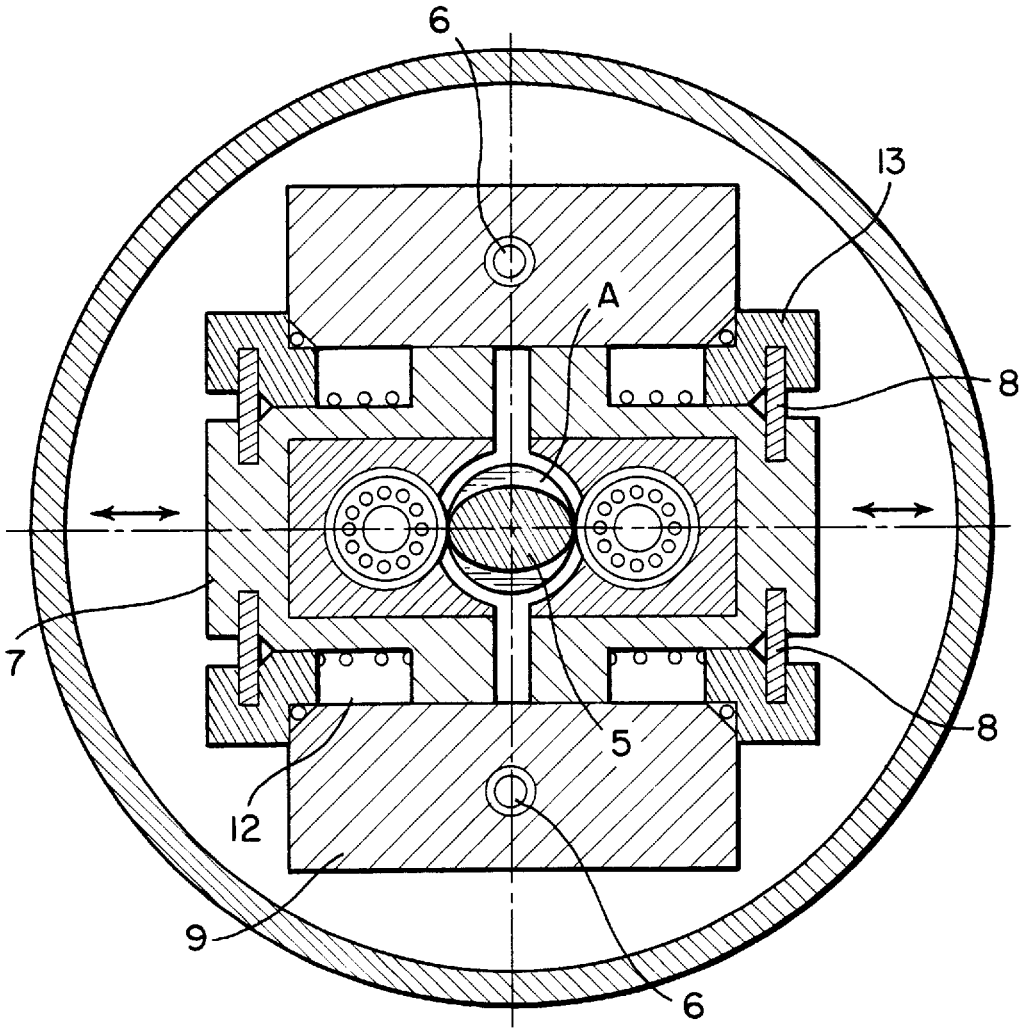
FIG. 2 shows a section 2—2 of FIG. 1.

The enclosed figures show a submerged pump according to the present invention, having a preferably cylindrical structure, consisting of:

An operation shaft A provided with opposing double eccentric cams 5 rotationally disposed within the structure. One or more modules each consists of pistons 7 provided with seals or preferably ring-shaped diaphragms 8, a wheel 10, pivoting pins 11, return springs 12, external bushings 13 and piston-carrying blocks 9 provided with a ball bearing 4. The return springs 12 are placed between the external bushings 13. The wheels 10 and pins 11 are placed on the pistons 7 between the pistons 7 and the cams 5 of shaft A. The plurality of modules are stacked coaxially along shaft A and fastened by means of assembling tie-rods 6. A segment 1 having a lower block 2 provided with sealing 3 and ball bearing 4 engages the shaft A and an upper cover 14 covers the modules. The rotation of shaft A determines which one of the cams 5 engage the respective module through wheel 10 and return springs 12. The reciprocating 7 caused thereby, which is sealed due to the presence of the seals or annular membranes 8, and due to their considerable surface, also for small movements, and the high rotation speed of shaft A, pressures and depression in working (pumping) chamber 16 is realized. Following openings and closings of the valves with elastomeric membranes 17 and 20 permit the pumping of the water in accordance with the aim set forth.

It shall be underlined that, while the known submerged pumps change their functional features and show a variation of pressures because—as they are operated by sun energy, the motor changes speed due to the variation of the sun influence—, the pump according to the present invention shows, in similar situations, a variety of capacity still keeping its own pressure constant.

For the purpose of preventing pulsations in the outlet liquid, and in a manner similar to what oftenly also occurs in the know volumetric pumps, the pump according to the present invention can provide in addition to the above described pump an elastic means, like airlocks, lungs or similar article downwards of the outlet tubing 22.

Beyond above mentioned advantages, the pump described in the enclosed figures has very small bearings 4, offering a consequent low energetic absorption, because it is symmetrical and balanced in such a manner as not to determine axial pushes onto the axis A of the motor, which usually force said bearings.

Finally, the pump according to the present invention has, beyond the advantage of being modular, also the advantage that power and capacity may be varied in an easy and simple manner, using cams of difference dimensions.

Between all possible applications, the pump according to the present invention may be used in inverse osmosis filtering, exploiting its exceeding pressures.

Finally half the internal volume of each pumping module is provided partially filled up with lubrication oil that is beaten by the movement of the components.

We claim:

1. A pump, comprising:

a housing assembly having a pumping chamber defined therein, said pumping chamber having an inlet and an outlet, an operating shaft having at least one cam lobe, said operating shaft being rotatably disposed in said housing assembly; and at least one piston module operationally engaged with said cam lobe, said piston module including at least two opposing pistons each slidably engaging a bushing member, at least two seals, each sealably engaged between one of said pistons and one of said bushing members and at least two springs, each biasing one of said pistons and one of said bushing members, wherein said piston experiences a reciprocating motion under influence of said cam lobe and said spring when said operating shaft rotates.

2. A pump, comprising:

a housing assembly having a pumping chamber defined therein, said pumping chamber having an inlet and an outlet;

an operating shaft having at least one cam lobe, said operating shaft being rotatable disposed in said housing assembly; and at least one piston module operationally engaged with said cam lobe, said piston module including at least one piston slidably engaging a bushing member, a seal sealably engaged between said piston and said bushing member and a spring biasing said piston and said bushing member, wherein said piston experiences a reciprocating motion under influence of said cam lobe and said spring when said operating shaft rotates, and said piston includes a pin having an urging member rotatably engaged thereon, said urging member contacting said cam lobe of said operating shaft, a portion of said cam lobe of said operating shaft moving said urging member and said piston outwardly and said piston being moved inwardly at another portion of said cam lobe by said spring when said operating shaft rotates.

3. The pump defined by claim 1, wherein:

said housing assembly includes an upper segment and a lower segment.

4. The pump defined by claim 3, wherein:

said lower segment includes a lower block having a sealing member and at least one ball bearing member for rotatably engaging said operation shaft.

5. The pump defined by claim 4, wherein:

said upper and said lower segments define said pumping chamber, said piston module being disposed within said pumping chamber.

6. The pump defined by claim 5, wherein:

said piston module defines an internal chamber, said internal chamber being partially filled with a lubricant, said lubricant being stirred by movement of said piston.

7. The pump defined by claim 6, wherein:

said at least one piston comprises two pistons.

8. The pump defined by claim 7, wherein:

said at least one piston module comprises two piston modules coaxially connected by a tie rod member.

9. The pump defined by claim 1, wherein:

said at least one piston module comprises two piston modules coaxially connected by a tie rod member.

* * * * *